US005121584A

United States Patent [19]

Suter

[11] Patent Number: 5,121,584

[45] Date of Patent: Jun. 16, 1992

[54] PROCESS AND MACHINE FOR FORMING A COIL OF MATERIAL

[75] Inventor: Hans Suter, Seon, Switzerland

[73] Assignee: Nokia-Maillefer Holding SA, Ecublens, Switzerland

[21] Appl. No.: 602,789

[22] Filed: Oct. 24, 1990

[30] Foreign Application Priority Data

Nov. 2, 1989 [CH] Switzerland ..... 3963/89

[51] Int. Cl.[5] ..... B65B 11/04

[52] U.S. Cl. ..... 53/116; 53/204; 53/372.9; 242/110.2

[58] Field of Search ..... 53/116, 204, 372.8, 53/372.9; 242/110.2

[56] References Cited

U.S. PATENT DOCUMENTS

| | | | |
|---|---|---|---|
| 209,020 | 10/1878 | Cass | 242/110.2 |
| 538,939 | 5/1895 | Warren | 242/110.2 |
| 2,341,722 | 2/1944 | Kelleher | 242/110.2 |
| 2,459,336 | 1/1949 | Powell | 242/110.2 |
| 2,972,454 | 2/1961 | Lord | 242/110.2 |
| 4,184,307 | 1/1980 | Kataoka | 53/372.9 |
| 4,524,562 | 6/1985 | Yagi | 53/372.9 |

FOREIGN PATENT DOCUMENTS

| | | |
|---|---|---|
| 0228997 | 7/1987 | European Pat. Off. . |
| 2375128 | 7/1978 | France . |
| 2426557 | 12/1979 | France . |
| 156403 | 6/1987 | Norway . |

*Primary Examiner*—John Sipos
*Attorney, Agent, or Firm*—Oliff & Berridge

[57] ABSTRACT

The drum (5) is at the station of wrapping and extraction of a coil of material wound on the segments (16) and bounded by the radial arms (24 and 21). Once the wrapping film has been placed about the coil of material and the arms (24 and 21), the cross-piece (17) is advanced so that the arms (21) are overturned backward and can be extracted from the front inner edge of the wrapping. Next, the pushers (28) move the wrapped coil of material by pressing against the rear flank of the wrapping between the arms (24). The latter pivot towards the front against the bias of the springs (26) so that their outer ends also pass under the inside edge of the rear flank of the wrapping. When the jack (19) returns the cross-piece (17) to its starting position, the arms (21) are righted by the action of the ramps (23). This device permits choosing the inside diameter of the coils of material at will, without being hindered by the presence of the radial arms (21).

8 Claims, 5 Drawing Sheets

PROCESS AND MACHINE FOR FORMING A COIL OF MATERIAL

It is known that continuously-produced elongated elements, such as flexible plastics tubes or electrical cables, for example, are frequently wound into coils, which permits them to be handled without moving a reel. However, in order that the coils of material may be easily manipulated, it is necessary for the two ends of the elongated element to be joined, and in the past few years various processes and various machines have been developed which, in most cases, comprised means permitting ties formed of cords or straps to be attached about the cross-section of the winding in different orientations. By way of example, French patent application No. FR-2,375,128 and European patent application No. EP-0,228,997 describe an automatic winder of this type. These automatic winders comprise drums for supporting and shaping the coils during winding, which drums comprise a hub and at least on one side of said hub a flange-like arrangement made of a series of arms able to move from a coil-limiting position to a coil extracting position, thus permitting the extraction of the coil to be effected automatically after binding.

More recently, it has been suggested that the binding of the coils of material be carried out by disposing about their periphery a sheet of extensible plastics material and pulling this sheet tight in such a way that its edges are turned down over the sides of the coil of material and surround its two axial faces and its periphery, forming a package having the appearance of a torus. French patent application No. FR-2,426,557, and Norvegian patent application No. 15 64 03 disclose such methods. However, the putting into practice of this binding method encounters various difficulties. In particular, it is necessary for the elongated product constituting the coil of material to be held in place during the arrangement of the wrapping sheet, and, for this purpose, the automatic machines used for producing the coils of material still must comprise radial arms which are disposed at least at one end of the cylindrical hub on which the elongated product is wound. As a result of the positioning of the sheet of extensible plastics material by pulling it tight over the circumference of the coil of material, the radial arms in question are inserted within the wrapping once it has been sealed.

According to the published Norwegian patent application No.-15 64 03, it has been provided, for remedying this difficulty, that the automatic winder be produced according to a design such that the radial arms can be slid radially inward in order to be extracted from the wrapping of the coil of material. However, this arrangement limits the possibility of choosing the inside diameter of the coil of material at will. It does not permit determining this inside diameter solely as a function of the flexibility of the elongated product and, consequently, producing coils of material having a minimum inside diameter in all circumstances, as has been the case until now.

It has been observed now that it is possible to design the flange-like arrangement of the drums in a more simple manner than heretofore, when the drums are intended to a winding machine wherein the coils are bound through an envelope made of an extensible film of plastics material.

The object of the present invention is to improve the process for forming coils of material comprising the wrapping of the latter in an extensible film of plastics material and to produce a machine permitting this process to be carried out under efficient and qualitatively better-developed conditions than heretofore.

To this end, the first subject of the present invention is a process for forming a coil of material, comprising the winding of an elongated, flexible element on a drum, said drum having an axis, the wrapping of the coil of material in an envelope having a toroid appearance and made of an extensible film of plastics material, then the extraction of the wrapped coil of material by displacement along said axis towards one of the sides of the drum, wherein the shape of the coil of material is determined during the winding on at least one side by folding arms disposed radially and capable of pivoting on their base, in that the film is shaped over these folding arms, and in that at the time of extraction the folding arms are over-turned toward the rear by advancement of their base.

The subject of the invention is also a automatic winding machine for carrying out the process according to claim 1, comprising a frame, at least one drum rotatively movable about an axis and comprising a hub and at least at one end of said hub a flange-like arrangement comprising a plurality of arms and means for moving said arms between a coil-limiting position wherein said arms radially protrude from said hub and a coil-extracting position wherein said hub is free at said end, said drum further comprising a support part axially movable with respect to said hub, between a retracted position and an extracted position, said arms being pivotally mounted on said support part so as to overturn when said support part displaces from said retracted to said extracted position.

There will be described hereafter, by way of example, an implementation of the subject of the invention and an embodiment of the respective machine, referring to the accompanying drawing, in which.

Figure 1:
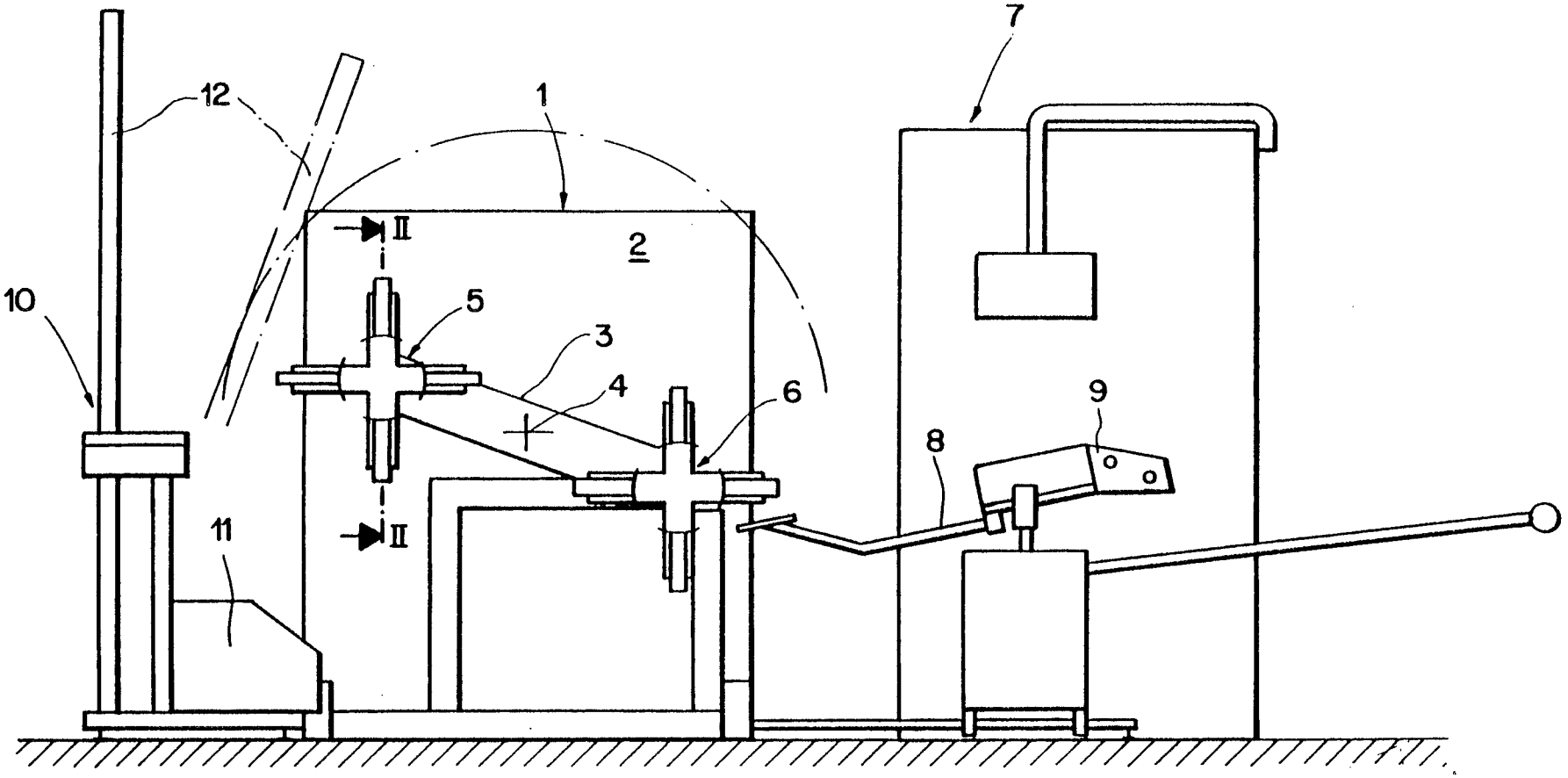
FIG. 1 is a general diagrammatic elevation of the machine.

The machine shown in FIG 1 comprises three separate parts. The winder 1 proper comprises a general frame 2, a barrel arm 3 mounted so as to be able to pivot about an axis 4 perpendicular to the plane of the drawing, two winding drums 5 and 6 which alternately move between a winding station and a wrapping and extraction station by rotation of the arm 3. This part 1 of the machine also comprises motor means and the transmission means necessary for actuating the arm 3, as well as the drums 5 and 6 and their auxiliary apparatus, as will be seen below.

The second main part of the machine is constituted by the feed device 7 which guides and controls the arrival of an elongated element, e.g., a tube of plastics material leaving a production line towards the drum which is situated at the winding station. This feed device need not be described in detail. It comprises in particular a guide tube 8 which is mounted on a support 9 in such a way that its end can guide the successive laying-down of turns formed on the drum by the elongated element.

This device can be moved closer to or away from the drum which is situated in winding position, and its control is carried out automatically.

The third important part of the machine is the wrapping apparatus 10 which comprises means 11 for receiving a roll of a film of extensible plastics material, guide means 12 which guide this elongated sheet of plastics material along a predetermined path so that, when a coil of material has been entirely formed on the drum situated in winding position, then when the elongated element has been cut and held attached to the drum after the cutting operation, the support 12 can dispose the sheet of plastics material so that a rotation of the drum brought into wrapping position brings about the tight deposit of this sheet over the circumference of the coil of material and its extension in its central portion in order that it completely surrounds the two flanks of the coil of material and its periphery. The apparatus also comprises means for joining the film to itself in order to keep it in welded position about the coil of material.

The apparatus 10 is also movable on its base so that it can be moved away from the automatic winder 1, particularly at the time of the operation of extraction of a wrapped coil of material.

Figure 2:
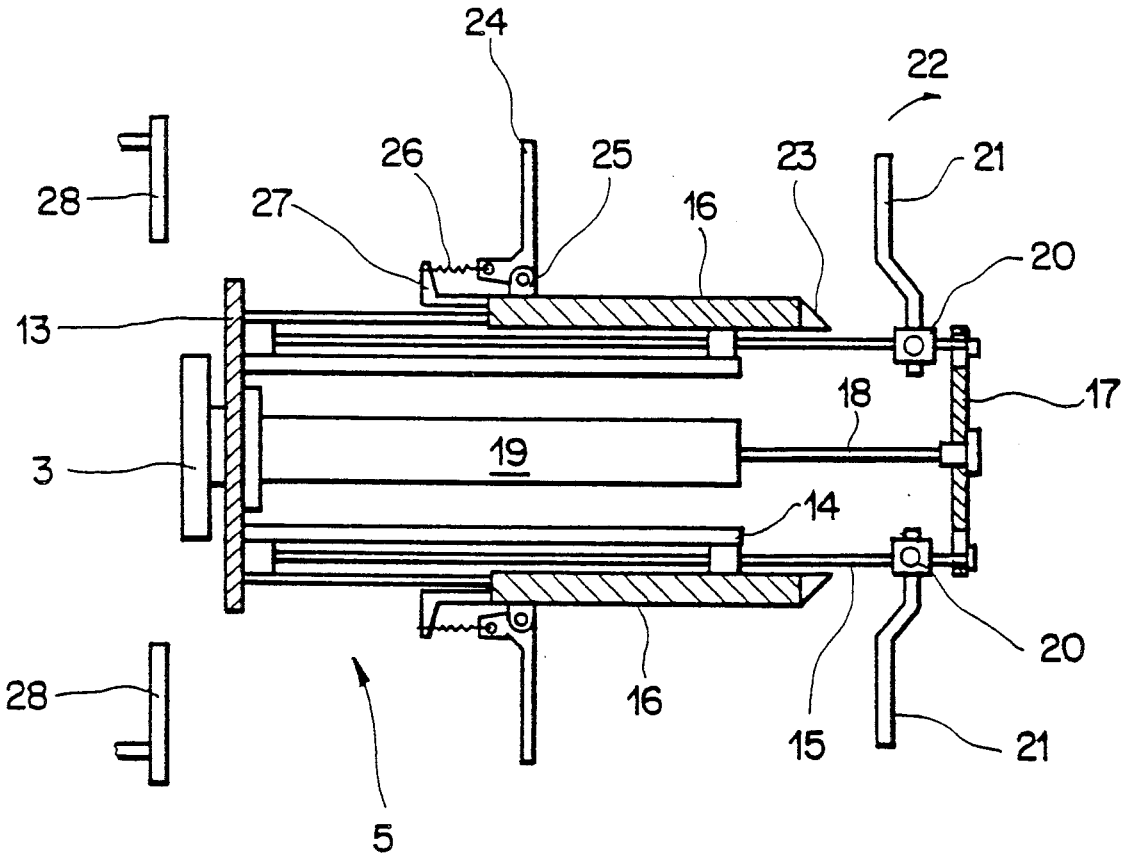
FIG. 2 is a diagrammatic partial axial section taken on the line II—II of FIG. 1.
Figure 3:
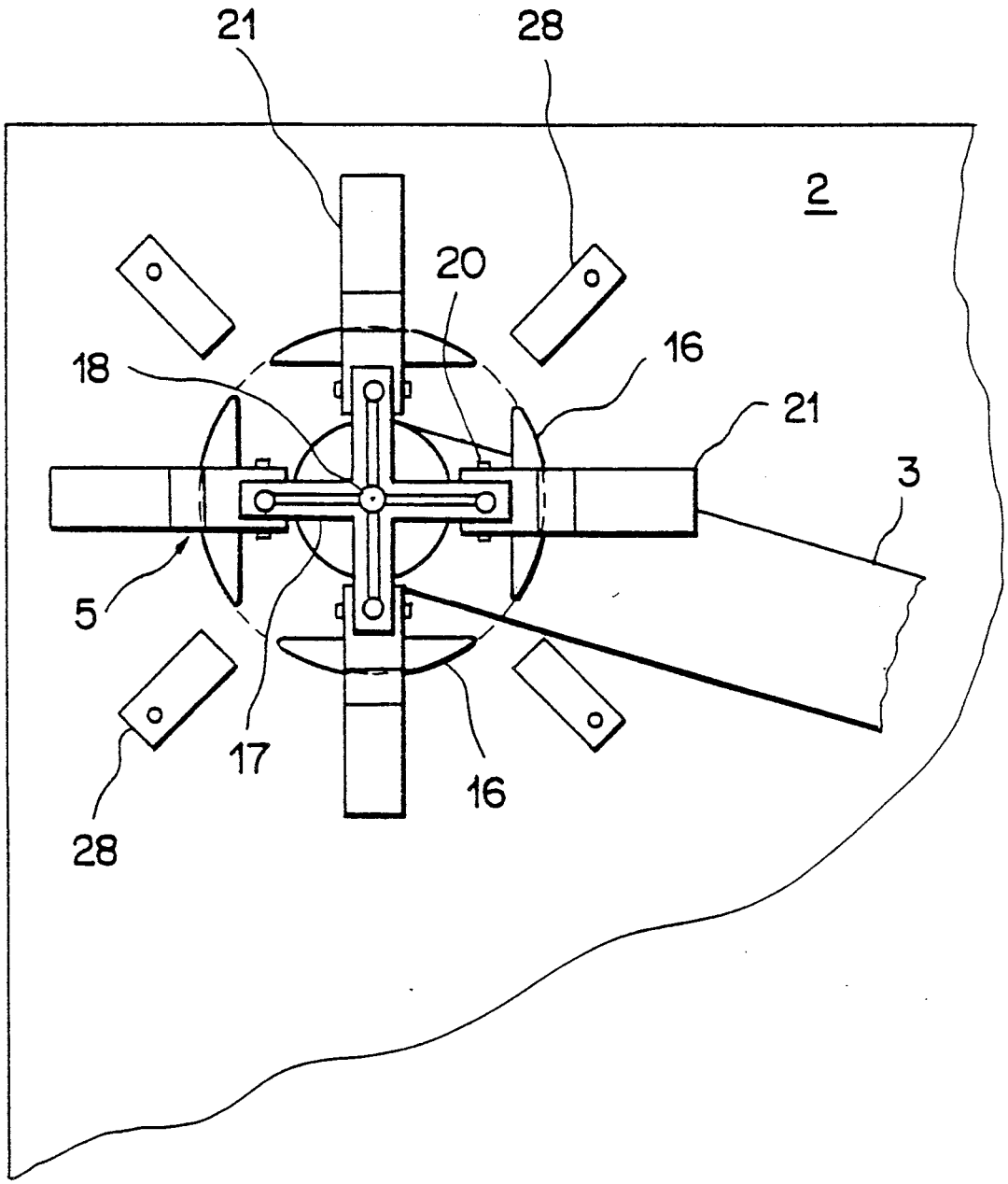
FIG. 3 is an elevation of the winder drum seen in FIG. 2 in the direction of arrow A of that drawing figure.

FIG. 2 shows diagrammatically certain details of the construction of each of the drums 5 and 6, these construction details being designed so as to permit the extraction of the coil of material once wrapped. This FIG. 2 shows the barrel arm 3, depicted in section, and a rotary plate 13 which pivots on one end of the arm 3 and constitutes the overall support of the drum. Fixed to the plate 13 are various framework elements 14 which extend axially and support sliding guide rods 15 and hub segments 16, these segments also being visible in FIG. 3. The framework elements 13, 14, and 16 are rigidly fixed to one another and define the cylindrical surface which constitutes the inside surface of the coil of material, i.e., the surface on which the winding of the elongated element is formed. At the outer ends, the guide rods 15 support a cross-piece 17 which is integral with a jack rod 18 capable of being actuated by hydraulic or pneumatic means feeding a jack cylinder 19 which is likewise fixed to the plate 13.

Each cross-piece 17 supports a set of folding devices 20 distributed about the periphery of the cross-piece and each of which holds a folding arm 21. Each device 20 comprises an axis of articulation, held in a direction tangential to the circumference of the cross-piece 17. On each of said axis of articulation pivotes a radial arm 21 composed of a rigid metal plate bent in a shape as shown on FIG. 2. In their coil limiting position these arms extend radially outwardly from cross-piece 17 and their outer portion radially protrude from the cylindrical outer circumference of hub 16. When cross-piece 17 is moved to the right in FIG. 2, the arms 21 can overturn towards a folding position as will be explained hereinafter. On the contrary, a rotation of folding arm 21 beyond the position shown in FIG. 2, in the direction of arrow 22 is locked by conventional stopping means integral with device 20, in a simple and reliable manner.

At the ends of the segments 16 on the coil-extraction side, these segments comprise ramps 23 which, as will be seen below, ensure the righting of the radial arms 21 when the cross-piece 17 is displaced by means of the jack 18, 19 in the direction opposite to the direction of extraction of the coil of material.

The segments 16 also bear, on the side opposite the radial arms 21, a second set of radial arms 24 which pivot on stirrups 25 about axes parallel to the axes of articulation of the arms 21 and which are normally held in radial position by springs 26, hooked to brackets 27 integral with the segments 16.

It will be noted that the positioning of the segments 16 might be adjustable radially relative to the framework 13, 14 so as to permit an adjustment of the drum as a function of the inside diameter which it is desired to give the coils of material.

It will further be noted that the drum 5 shown in FIG. 2 is supposed to be at the wrapping station and that, at that station, it is coincident with a set of pushers 28 which are mounted on the general frame 2 and can be displaced axially for undertaking the extraction of the coil of material, as will be seen below.

Figure 4:
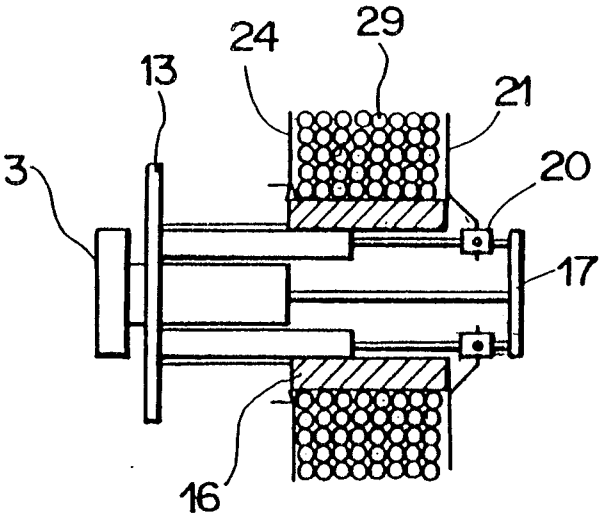

FIGS. 4 to 8 illustrate diagrammatically the various operations which take place starting from the moment when the drum 5 or 6, on which the winding of a coil of material has been carried out at the winding station, has arrived at the wrapping and extraction station. In FIG. 4, there is seen a finished coil of material 29, held in place between the segments 16 and the radial arms 24 and 21. The cross-piece 17 is in its retracted position. At the time of the rotation of the barrel 3, a knife (not shown) has cut the elongated element so that the end joined to the feed device 7 can be fixed to the empty drum which is at the winding station, the outside end of the elongated element constituting the coil of material 29 being itself held by the knife of the respective drum.

Figure 5:
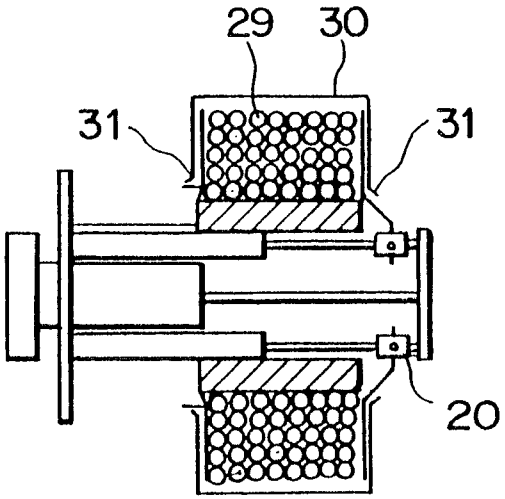

As is seen in FIG. 5, in this position, the sheet of plastics material 30 is wound about the coil of material 29 and pulled in such a way that its central portion stretches, its marginal portions then forming the two axial flanks of the wrapping, which has the shape of a torus of rectangular cross-section. The inner edges 31 of the wrapping extend along circumferences whose diameters correspond to the outside diameter of the cylindrical surface defined by the segments 16. The particular operation of winding the sheet of plastics material about the coil of material is known per se; it is therefore not necessary to describe it here. It is carried out by a rotational movement of the drum on which the coil of material is mounted.

Figure 6:
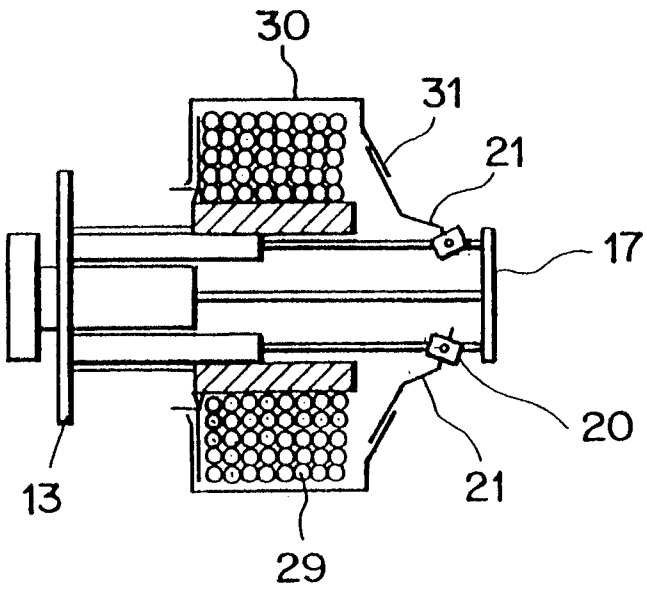
FIGS. 4 to 8 are simplified diagrammatic drawing figures illustrating different stages of the operations of winding, wrapping, and extraction of a coil of material.

FIG. 6 illustrates the following operation, consisting in extracting the radial arms 21 which are, as is seen in FIG. 5, imprisoned within the film 30. The jack 18, 19 is actuated so that the cross-piece 17 is moved in the direction of extraction. The arms 21 are then overturned backward, pivoting about their joints. The inner edge 31, situated on the outer side, moves away slightly from the coil of material at the locations where the arms 21 are situated so as to permit these arms to come out of their imprisonment. It has been found that the material suitable for being used to form the wrapping 30 has sufficient elasticity to move aside slightly and permit the freeing of the arms 21.

Figure 7:
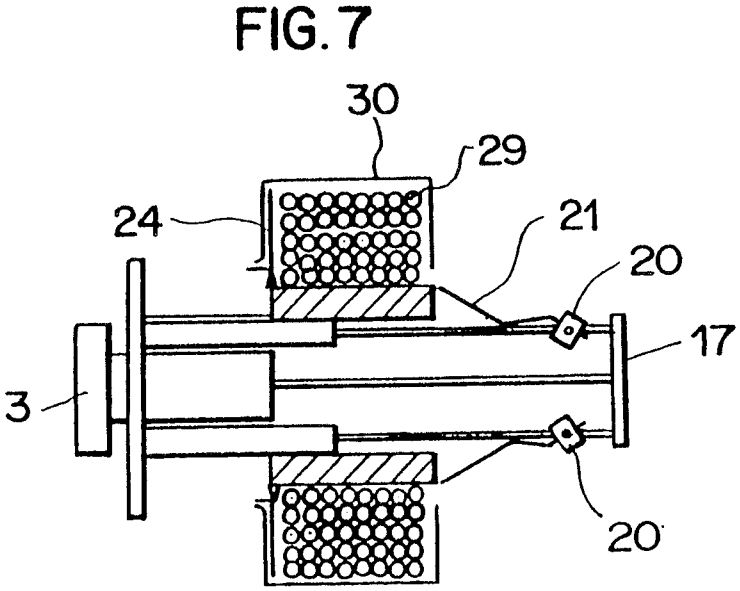

FIG. 7 illustrates the following stage of the operation, in which the cross-piece 17 has reached its position of farthest advance, and the arms 21 are completely overturned backward and disengage the envelope 30, which once more flattens itself against the coil of material 29.

Figure 8:
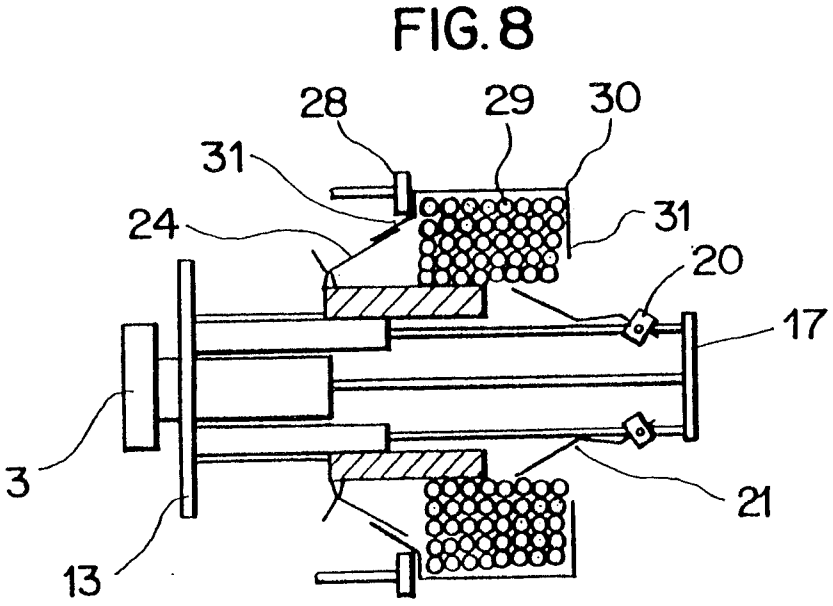

Finally, FIG. 8 illustrates the last operation. The pushers 28 are advanced and push the wrapped coil of material 29 by pressing on the outside edge of the rear flank of the wrapping 30. The inside edge of this wrapping 30 is deformed slightly at the location of the rear radial arms 24, which pivot towards the front about their axis of articulation on the stirrups 25 against the bias of the springs 26. It will be realized that, in this way, the extraction of the coil of material can be carried out.

When the coil of material has been disposed of, the radial arms 24 resume their normal position under the effect of the springs 26, and the arms 21 return to their radial position by sliding on the ramps 23 when the cross-piece 17 is brought back into retracted position.

A particular advantage of the system which has just been described is that the finished and wrapped coil of material remains supported concentrically on the drum until the end of its extraction.

What is claimed is:

1. An automatic winding machine for forming a coil of material, comprising:

a frame, at least one drum rotatively movable about an axis, said drum for supporting said coil comprising a hub, a flange-like arrangement comprising a plurality of arms positioned on at least one axial end of said hub and foldable inwardly toward the other end of said hub, and means for moving said arms between a coil-limiting position wherein said arms radially protrude from said hub to hold said coil and a coil-extracting position wherein said arms are folded toward the other end of the hub into a position substantially parallel to said axis so that said hub is free at said end and the coil can be axially removed, said drum further comprising a support part axially movable with respect to said hub, between a retracted position near said hub end and an extracted position spaced from said hub end, said arms being pivotably mounted on said support part so as to pivot inwardly toward said other end of said hub when said support part displaces from said retracted to said extracted position.

2. The automatic winding machine of claim 1, wherein said at least one drum further comprise means for holding said arms in said coil-limiting position when said support part is in said retracted position.

3. The automatic winding machine of claim 1, wherein the drum comprises hub segments distributed about the axis of the drum and defining the inside diameter of the coil of material.

4. The automatic winding machine of claim 1 wherein the drum comprises a set of ramps capable of causing the righting of the pivoting arms at the time of a displacement of the support part from the extracted position towards the retracted position.

5. The automatic winding machine claim 1, wherein the support part is a cross-piece guided and supported by bars integral with the framework of the drum and oriented parallel to the axis thereof.

6. An automatic winding machine for forming a coil of material comprising:

a frame;

a barrel arm pivotably mounted to the frame at a center point of the barrel arm;

two drums mounted at opposite ends of the barrel arm for supporting coils and rotatable about their axis each drum equipped with an axially movable support part, a set of radial arms pivotally mounted on one end of said support part, a jack for driving said set of radial arms inwardly toward the other end of said support part and toward the center of the drum from a coil holding position wherein said arms radially protrude from said drum to an inward position wherein said arm lie substantially parallel to the drum axis to allow the axial removal of the coil from the drum;

wherein the barrel arm is movable between a first station wherein the material is wound upon the drums and a second station wherein the material is removed from the drums.

7. The automatic winding machine of claim 6, wherein each drum further comprises a second set of folding radial arms, the second set of arms being capable of sloping, starting from a radial position, so that their outside ends move in the direction of removal of the coil of material and in the centripetal direction at the same time.

8. The automatic winding machine of, claim 7, wherein the second set of folding arms is held in the radial position by springs which tend to return them to the radial position when they have been moved away at the time of removal of a wrapped coil of material.

* * * * *